United States Patent [19]

Wang

[11] Patent Number: 4,909,347

[45] Date of Patent: Mar. 20, 1990

[54] EXHAUST TUBE

[75] Inventor: Chan-Yan Wang, 13th Fl., No. 4, Lane 204, Song Shan Rd., Taipei, Taiwan

[73] Assignees: Chan-Yan Wang; Chwan-Shyh Wang; Shih Po-Hsiang, all of Taipei, Taiwan

[21] Appl. No.: 386,092

[22] Filed: Jul. 28, 1989

[51] Int. Cl.[4] ..... F01N 1/08

[52] U.S. Cl. ..... 181/272; 181/264; 181/282

[58] Field of Search ..... 181/228, 264, 272, 282

[56] References Cited

U.S. PATENT DOCUMENTS 2,287,412 6/1942 Bourne ..... 181/272

4,361,206 11/1982 Tsai ..... 181/272 X 4,501,341 2/1985 Jones ..... 181/272 X 4,574,913 3/1986 Fukuda ..... 181/272 X

*Primary Examiner*—B. R. Fuller

*Attorney, Agent, or Firm*—Browdy and Neimark

[57] ABSTRACT

An exhaust tube capable of having a better silencing effect without adversely affecting the horsepower output of an engine is provided. The exhaust tube includes a tube body having two end plates, two spaced disks dividing the tube body into three gas chambers and a pipe having an expanded first end, a first horizontal portion, an inclined portion having a verturi tube, a perforated second horizontal portion, and a second opposite free end.

3 Claims, 4 Drawing Sheets

EXHAUST TUBE

BACKGROUND OF THE INVENTION

The present invention relates to an exhaust tube, and more particularly to one have a better silencing effect.

Conventionally, an exhaust pipe for a car, as shown in FIGS. 1 and 4, includes an exhaust manifold 1 fixed to an engine, one or two straight type silencing tubes 2 (2A), a separating type silencing tube 3, and a plurality of connecting pipes in order to discharge the exhaust gas into the environmental atmosphere. Straight type silencing tube 2, as shown in FIG. 2, includes a tube body 4 having two end plates and a cylindrical iron piece 5, and a central pipe 6 connected to and passing through the end plates and having perforations 7 which enable that shocking sound waves of the shocking exhaust gas will counteract with each other in the hollow portion of tube body 4 through a resonating effect occurring therein. Such tube 2 does not provide any resistance against the exhaust gas flow since central pipe 6 is straight. Although it does not adversely affect the operation or the horsepower output of the engine, it does not have a good silencing effect. In order to cope with this problem, the separating type silencing tube 3 is added to the exhaust pipe assembly.

Separating type silencing tube 3, as shown in FIG. 3, includes a tube body 8 having two end plates, two spaced separating disks 9, 10 respectively having communicating slots 11, 12, and two guiding pipes 13, 14 which are respectively mounted on the two end plates, respectively have one ends thereof closed by disks 9, 10 and respectively include in tube body 8 perforations 15, 16, so that the exhaust gas will pass from pipe 13, through perforations 15, slots 11, slots 12, perforations 16, and then pipe 14, into the atmosphere. Such separating type tube 3 can effectively cancel the shocking sound waves of the shocking exhaust gas to achieve a better silencing effect, however, it produces a substantial resistance against the exhaust gas flow to reduce the engine horsepower output which can be evidenced by the fact that if silencing tube 3 is taken off, the engine horsepower output is greatly increased.

SUMMARY OF THE INVENTION

It is therefore an object of the present invention to provide an exhaust (or silencing) tube having a better silencing effect while still not adversely affecting the engine horsepower output.

According to the present invention, an exhaust tube includes a tube body having two end plates, two spaced disks dividing the tube body into three gas chambers and a pipe having an expanded first end, a first horizontal portion, an inclined portion having a venturi tube, a perforated second horizontal portion, and a second opposite free end.

The present invention may best be understood through the following description with reference to the accompanying drawings, in which:

DETAILED DESCRIPTION OF THE PREFERRED EMBODIMENT

Figure 1:
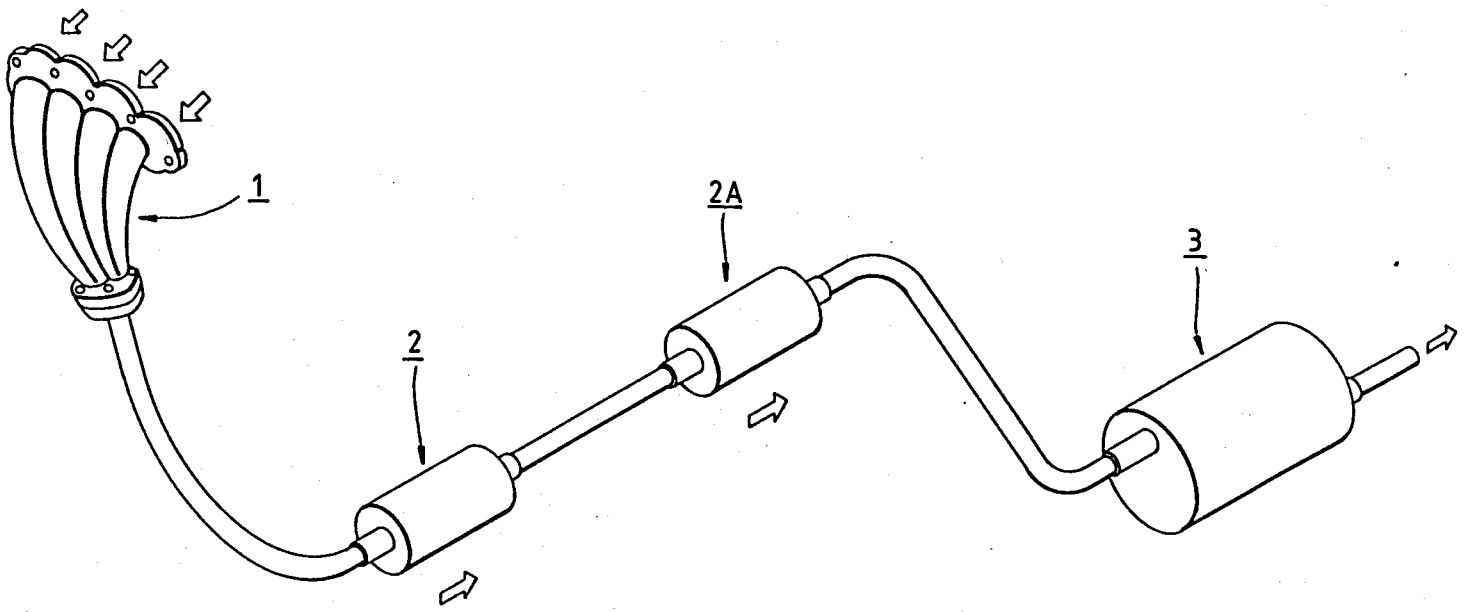
FIG. 1 PRIOR ART
FIG. 1 is a perspective view showing an exhaust pipe according to the prior art.
Figure 3:
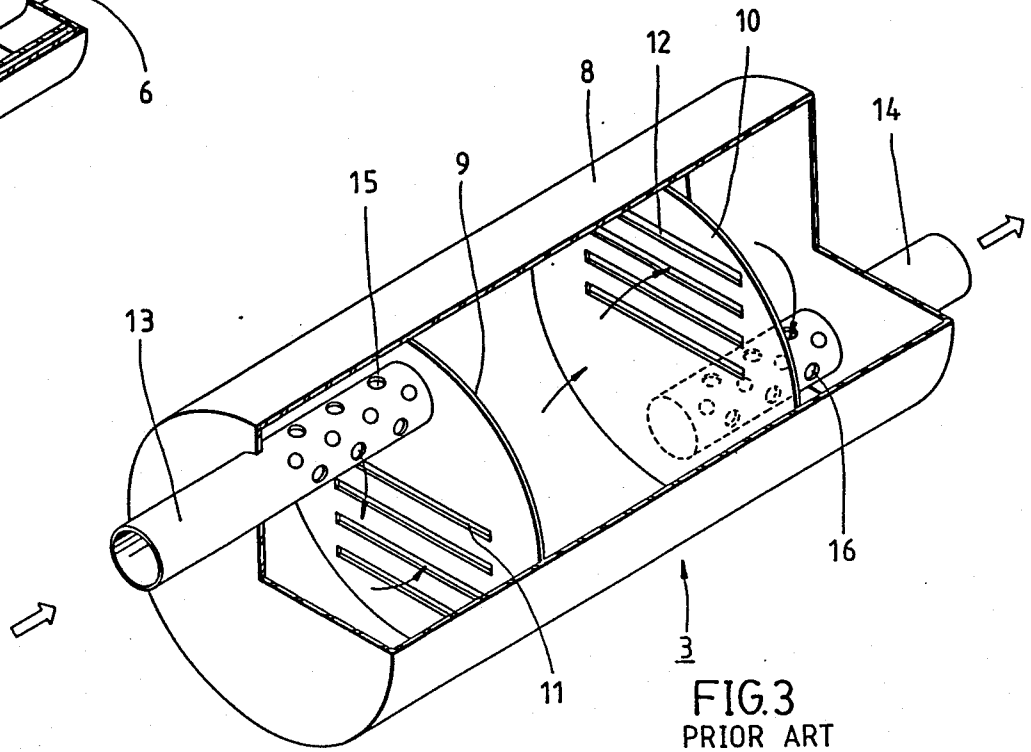
FIG.3 PRIOR ART
FIG. 3 is a fragmentarily perspective view showing a separating type silencing tube in FIG. 1.
Figure 2:
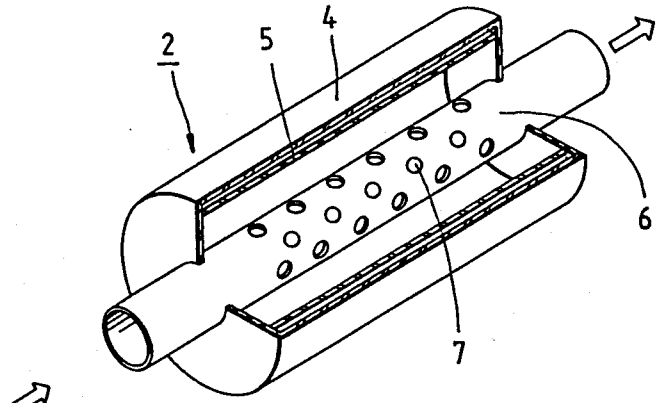
FIG. 2 PRIOR ART
FIG. 2 is a fragmentarily perspective view showing a straight type silencing tube in FIG. 1.
Figure 4:
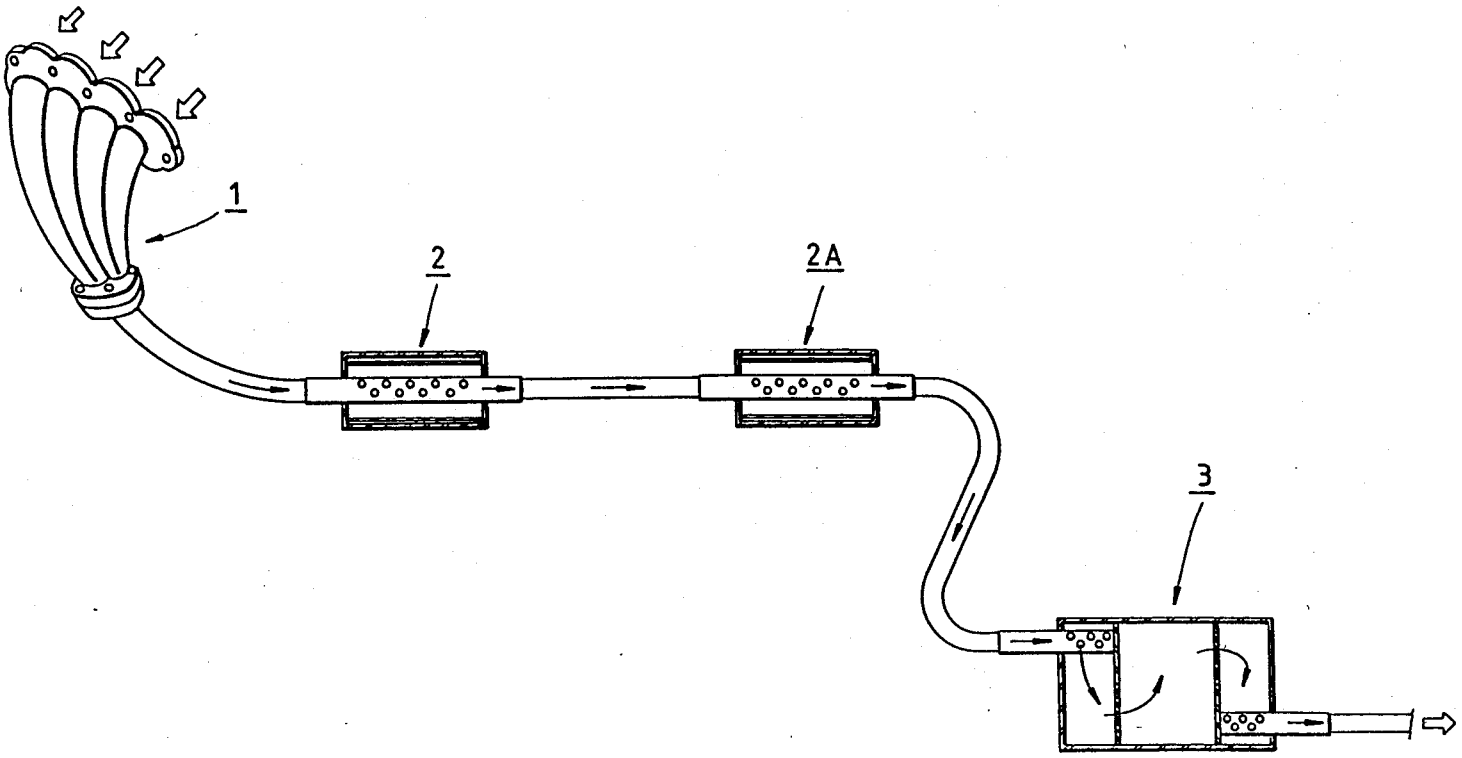
FIG. 4 PRIOR ART
FIG. 4 is a schematic view showing the exhaust gas flow in the exhaust pipe in FIG. 1.
Figure 5:
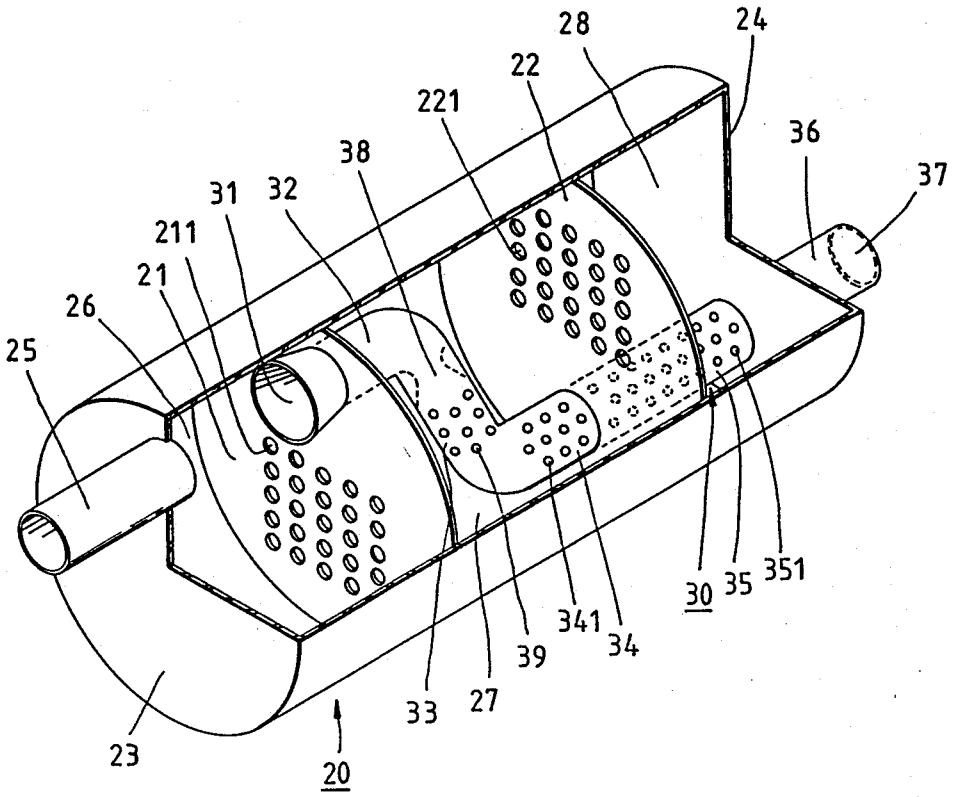
FIG. 5 is a schematically perspective view showing a preferred embodiment of a silencing tube according to the present invention.

Referring now to FIG. 5, a silencing (or exhaust) tube according to the present invention includes a tube body 10 axially securing therein two spaced disks 21, 22, and a pipe 30 having an expanded first end 31, a first horizontal portion, an inclined portion 33, a second horizontal portion containing consecutive segments 34, 35, 36, and a second opposite free end 37 for discharging the exhaust gas into the environmental atmosphere. The tube body 20 includes a left and a right end plates 23, 24. With the left one 23 adapted to mount thereon a pipe 25 guiding the exhaust gas into the present exhaust tube. Disk 21, 22 together with the end plates 23, 24 divide the tube body 20 into 3 gas chambers 26, 27, 28 and are respectively provided with perforations 211, 221, to enable gas chambers 26, 27, 28 mutually communicable. Portion 32 mounted on the left disk 21 forms at the freeend thereof expanded end 31 facing toward pipe 25 for collecting the exhaust gas flow guided by pipe 25. The inclined portion is inclinedly connected between first and second horizontal portions 32 and 34, 35, 36, mounts therein a venturi tube 38, and includes a plurality of perforations 39 in order to communicate with gas chamber 27. The second horizontal portion (34, 35, 36) is parallel with and vertically spaced with respect to first horizontal portion 32. Segment 34 includes a plurality of perforations 341 facing toward the central portion of venturi tube 38. Segment 35 includes perforations 351 in order to communicate with gas chamber 28.

The working principle of the present invention is as follows:

Since the exhaust gas is discharged from the engine cylinders one by one, the exhausting waves must theoretically have a zero value between every two continuous ones no matter how fast the engine is running. After the exhaust gas gets through pipe 25 into chamber 26, it fills up chamber 26 and pressurizes through end 31 portion 32 which can be considered as closed since it will produce a back pressure through an increased pressure by the provision of the inclined portion having therein the venturi tube 36. It the pressure in chamber 26 is larger than that of chamber 27, the exhaust gas will flow through perforations 211 into chamber 27 and the gas in portion 32 will pass through venturi tube 38 to segment 34 having perforations 341. If the pressure in segment 34 is larger than the of chamber 27, the gas therein will also flow through perforations 341 into chamber 27 having an initial pressure higher than that of chamber 28 so that the gas in chamber 27 will flow through perforations 221 into chamber 28 having a pressure larger than that of segment 35 so that the gas in chamber 28 will flow through perforations 351 into segment 35 to transmit through segment 36 to the atmosphere. This situation is reached by several exhausting waves in the initial running of the engine. The size and the number of perforations 351 are determined by the discharging quantity of the exhausting wave.

Upon much exhausting condition of the engine, the pressure in portion 32 is fast increased through the provision of expanded end 31. After chambers 26, 27, 28 have a saturated pressure and segment 34 and chamber 27 are in a pressure equilibrium state, the exhaust gas will discharge directly through segments 35, 36 out of the tube body. Upon the end of each exhausting wave or the transiently no exhausting state, segment 35 will suck through perforations 351 the gas in chamber 28 to form a sub-gas flow exhausting through chambers 26, 27, 28 and segments 35, 36 to lower the pressure in the present exhaust tube to thus achieve the function the present invention contemplates.

What I claim is:

1. An exhaust tube comprising:

a tube body having a first end plate and a second opposite end plate with said first end plate adapted to mount thereon a pipe guiding an exhaust gas into said exhaust tube;

two spaced disks axially secured in said tube body to so divide said tube body into three gas chambers and respectively perforated to enable said gas chambers mutually communicable; and a pipe connected to and passing through said disks and said second end plate and including an expanding first end facing toward said guiding pipe and positioned in a first one of said gas chambers, a first horizontal portion mounted on a first one of said disks and forming at a free end thereof said expanded end, a second horizontal portion being parallel with and vertically spaced with respect to said first horizontal portion and having thereon perforations in a third said gas chamber defined between said second end plate and a second said disk, and a second opposite free end positioned outside of said tube body and being a free end of said second horizontal portion.

2. An exhaust tube according to claim 1, wherein:

said pipe further includes an inclined portion connected between said first and second horizontal portions and mounting therein a venturi tube; and said second horizontal portion includes a plurality of perforations facing toward a central portion of said venturi tube.

3. An exhaust tube according to claim 2 wherein said inclined portion includes a plurality of perforations communicating said inclined portion with a second said gas chamber defined between said disks.

* * * * *